United States Patent [19]

Nelson et al.

[11] Patent Number: 4,739,187

[45] Date of Patent: Apr. 19, 1988

[54] SELF-CONTAINED SWITCH FOR ILLUMINATING LAMP WITH EMERGENCY SIGNAL CAPABILITY

[75] Inventors: Michael P. Nelson, Chester, W. Va.; William A. Marino, 556 Virginia Ave., Chester, W. Va. 26034; Valentino M. Mosticone, Pittsburgh, Pa.

[73] Assignee: William A. Marino, Chester, W. Va.

[21] Appl. No.: 906,996

[22] Filed: Sep. 12, 1986

[51] Int. Cl.[4] ..... G08B 23/00

[52] U.S. Cl. ..... 307/115; 307/117; 337/85; 337/86; 337/87; 340/331; 340/332

[58] Field of Search ..... 307/112, 115, 117; 200/310, 312, 313, 315, 316, 317, 308, 339, 334, 153 G, 153 H, 61.27; 340/330, 331, 332, 333, 72, 73, 74, 76, 81 R, 82, 83; 337/85, 86, 87, 88, 95, 44, 92, 138, 340; 361/58; 315/291, 292, 86, 82, 83; 362/95

[56] References Cited

U.S. PATENT DOCUMENTS

| | | | |
|---|---|---|---|
| 2,196,501 | 4/1940 | Kehm | 200/315 |
| 2,214,317 | 9/1940 | Bash et al. | 200/315 |
| 2,512,975 | 6/1950 | Sherrard | 200/315 |
| 3,119,046 | 1/1964 | Usher | 200/317 X |
| 3,196,239 | 7/1965 | Maxted et al. | 200/315 |
| 3,294,945 | 12/1966 | McLaughlin | 200/315 |
| 3,301,988 | 1/1967 | Weitzman | 200/315 |
| 3,383,671 | 5/1968 | Palos et al. | 307/115 X |
| 3,599,201 | 8/1971 | Montgomery | 340/332 X |
| 3,624,635 | 11/1971 | Less | 340/326 |
| 3,725,834 | 4/1973 | Dorsey et al. | 337/44 |
| 3,863,236 | 1/1975 | Clardy | 340/331 X |
| 3,928,834 | 12/1975 | Soong | 337/38 X |
| 3,991,415 | 11/1976 | Baar | 340/326 X |
| 4,038,582 | 7/1977 | Horwinski | 200/317 X |
| 4,047,165 | 9/1977 | Andreasson et al. | 340/331 X |
| 4,255,780 | 3/1981 | Sakellaris | 200/310 X |
| 4,276,542 | 6/1981 | Russ | 340/331 X |
| 4,479,170 | 10/1984 | Richardson | 200/315 X |
| 4,556,863 | 12/1985 | Devitt et al. | 340/332 X |
| 4,642,477 | 2/1987 | Grzanowski et al. | 307/112 X |

*Primary Examiner*—William M. Shoop, Jr.
*Assistant Examiner*—Paul Ip
*Attorney, Agent, or Firm*—Harry B. Keck

[57] ABSTRACT

A self-contained switch unit for controlling a remote illuminating lamp has, in a common housing, a main ON/OFF switch, and has an emergency signal ON/-OFF switch in a common housing, and has a visible pilot lamp. The main ON/OFF switch controls the ON or OFF mode of the illuminating lamp. The emergency signal ON/OFF switch functions, when the main ON/-OFF switch is in the ON mode, to cause the controlled illuminating lamp to flash as a signal. When the controlled lamp is lighted, the pilot lamp is dark. When the controlled lamp is dark, the pilot lamp is lighted. When the controlled lamp is in the flashing mode, the pilot lamp also is in a flashing mode.

4 Claims, 1 Drawing Sheet

SELF-CONTAINED SWITCH FOR ILLUMINATING LAMP WITH EMERGENCY SIGNAL CAPABILITY

BACKGROUND OF THE INVENTION

1. Field of the Invention

This invention relates to electric switches particularly adapted for use with outdoor illuminating lamps and more particularly relates to a self-contained switch unit providing an emergency signal capability for such illuminating lamp.

Residential houses customarily have an illuminating lamp near a front door which is activated by an ON/-OFF switch located inside the house. In emergencies, it is desirable to provide some visible signal outside the house to indicate that an emergency exists so that neighbors or passersby can take appropriate action; and to identify the house so that emergency professionals (police, firemen, paramedics) can move directly with certainty toward the house.

2. Description of the Prior Art

U.S. Pat. No. 3,725,834 provides a single switch having three positions (ON, OFF, SIGNAL-FLASHING) for use with an illuminating lamp. The three-position switch is relatively expensive to fabricate and provides no visible indication to an operator in a darkened room containing the switch that the switch is in the emergency signal mode or that the illuminating lamp is ON or OFF.

STATEMENT OF THE PRESENT INVENTION

According to the present invention, a compact self-contained switch unit is provided which can be installed in a conventional electrical junction box as a direct replacement for a conventional ON/OFF switch which controls an outdoor lamp such as a porch light or pole lamp. The self-contained switch unit has a main ON/-OFF switch and has another emergency signal ON/-OFF switch to convert the operation of the controlled illuminating lamp to an emergency signal mode, i.e., a flashing operation. A small pilot lamp is presented in the face of the self-contained switch unit (a) to indicate visibly that the controlled illuminating lamp is ON or OFF; and (b) to indicate visibly that the controlled illuminating lamp is in the emergency signal (flashing) mode.

A further feature of the switch unit is the provision of added terminals to permit the main ON/OFF switch to operate lamps or other electrical devices in addition to the illuminating lamp which is under the control of the emergency ON/OFF switch.

DESCRIPTION OF THE PREFERRED EMBODIMENTS

Figure 1:
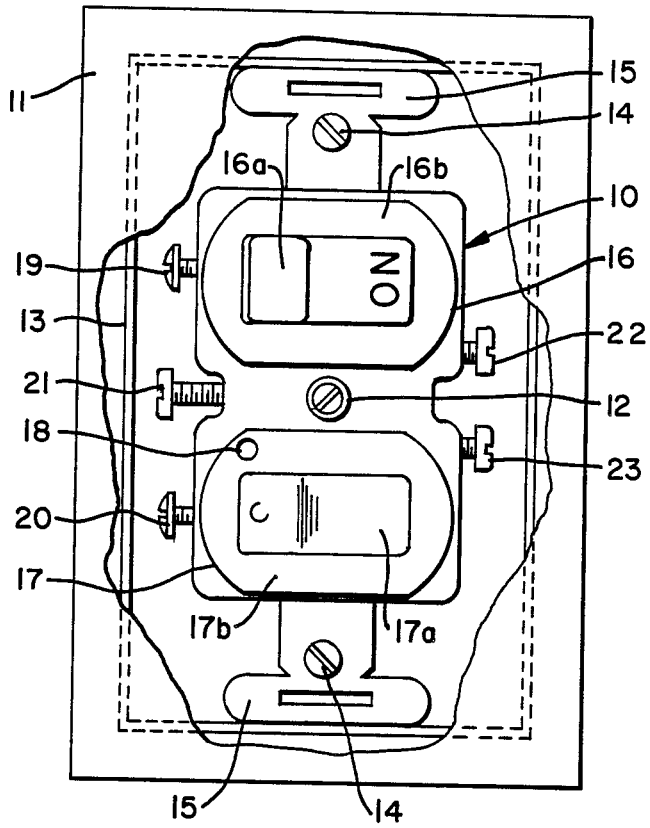
FIG. 1 is a plan view of the preferred embodiment of a self-contained switch unit with a cover plate being shown partly broken-away.

FIG. 1 shows a self-contained switch unit 10 behind a cover plate 11 which is illustrated in phantom outline. The cover plate 11 is secured to the switch unit 10 by means of a cover plate screw 12.

The switch unit 10 is secured in a junction box 13 by means of screws 14 extending through openings in mounting brackets 15.

The switch unit 10 includes a main ON/OFF switch 13 which is preferably a toggle switch having an ON position and an OFF position. The main ON/OFF switch 16, as shown, has a toggle **16*a* in a housing 16*b*. The switch unit 10 also includes an emergency signal ON/OFF switch 17. The emergency signal ON/OFF switch 17 preferably is not the same type of switch as the main ON/OFF switch 16. For example, if the main ON/OFF switch 16 is a toggle switch, then the emergency signal ON/OFF switch 17 preferably is a rocker switch. The emergency signal ON/OFF switch, as shown, has a rocker element 17*a* in a housing 17*b*. Also it is preferred that the main ON/OFF switch 16 operating element (e.g., a toggle) be of one color (e.g., white) and that the emergency signal ON/OFF switch 17 operating element be of a different color (e.g., red). A pilot lamp 18, which is provided within the switch unit 10, can be observed through the cover plate 11. Preferably the pilot lamp 18 is integral with the housing 17*b* of the emergency signal ON/OFF switch 17**.

The switch unit 10 includes terminals 19, 20, to be connected to electrical conductors (not shown in FIG. 1), and, if desired, a ground wire terminal 21. Additional terminals 22, 23 may be provided for using the main ON/OFF switch 16 to control additional lamps or electrical devices which will not be subjected to the emergency signal flashing provided by the emergency signal ON/OFF switch 17.

Figure 2:
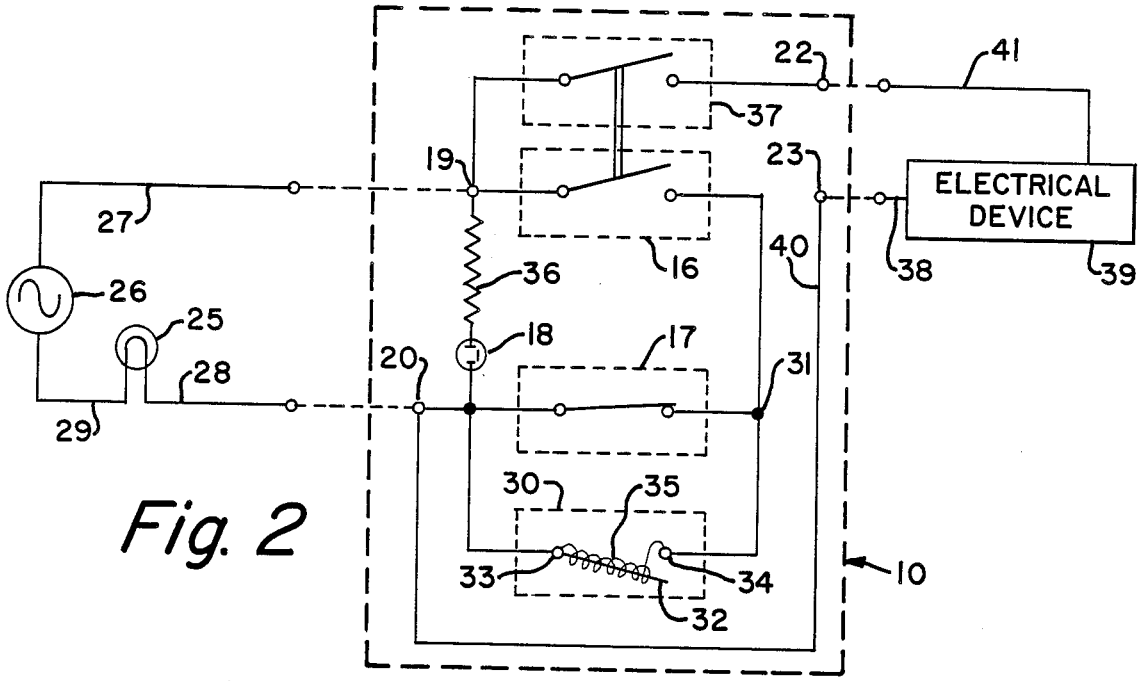
FIG. 2 is a schematic illustration of one embodiment of electric circuitry which can be included in the self-contained switch unit.

Referring to FIG. 2, a typical illuminating lamp 25, mounted outside a residential house, is connected in series with a source 26 of electrical energy through conductors 27, 28, 29. The conductors 27, 28 are connected to the switch terminals 19, 20 respectively of the switch unit 10. Three individual switches are provided within the switch unit 10 including a main ON/OFF switch 16, an emergency signal ON/OFF switch 17 and a thermal bimetallic, normally open switch 30. The main ON/OFF switch 16 connects the terminal 19 to an intermediate terminal 31. The normally closed emergency signal ON/OFF switch 17 connects the terminal 20 to the intermediate terminal 31. The thermal bimetallic switch 30 connects the terminal 20 to the intermediate terminal 31 and thus is assembled in parallel with the emergency signal ON/OFF switch 17.

The thermal bimetallic normally open switch 30 has a bimetallic conductor 32 which is secured to a switch contact 33 and is normally spaced-apart from a switch contact 34. A high resistance heating wire 35 is connected to the contacts 33, 34 and is in a heat transferring relationship with the bimetallic conductor 32. When a significant electric current flows through the high resistance heating wire 35, the bimetallic conductor 32 becomes heated and moves toward engagement with the switch contact 34, thus closing an electrical circuit between the intermediate terminal 31 and the terminal 20.

A pilot lamp 18, preferably a gas-glow lamp, is connected in series with a high resistance 36 (several thousand ohms) between the terminals 19, 20.

So long as the main ON/OFF switch 16 is open, the pilot lamp 18 will be illuminated because the pilot lamp 18 and resistance 36 are connected across the terminals 19, 20. When the main ON/OFF switch 16 is closed and the emergency signal ON/OFF switch 17 is in its normal closed position, the voltage applied across the terminals 19, 20 divides the current through (a) the low resistance passage from the terminal 19 through the main ON/OFF switch 16, the intermediate terminal 31 and the emergency signal ON/OFF switch 17 and (b) the alternative path through the pilot lamp 18 and the high resistance 36. Insufficient current flows through the pilot lamp 18 and high resistance 36 to eliminate the pilot lamp 18 when the illuminating lamp 25 is ON. Hence, the pilot lamp 18 is OFF when the illuminating lamp is ON. Alternatively when the illuminating lamp 26 is OFF as a result of open switches in the switch unit 10, the voltage between terminals 19, 20 applied across the pilot lamp 18 and the high resistance 36 is sufficient so that the pilot lamp 18 will be ON.

The alternative terminals 22, 23 are connected through a second ON/OFF switch 37 which is mechanically ganged to the main ON/OFF switch 16. The second ON/OFF switch 37 is connected between the terminals 19, 22. The other alternative terminal 23 is connected by a conductor 41 to the terminal 20.

Lamps or other devices 39 are connected through conductors 38, 41 to the alternative terminals 22, 23. When the main ON/OFF switch 16 is closed, the second ON/OFF switch 37 also is closed to complete a circuit through the lamps or other devices 39 which is unaffected by the emergency ON/OFF switch 17.

OPERATION

I. Outdoor lamp 25 OFF.

The main ON/OFF switch 16 is open (i.e., in the OFF position) and the emergency signal ON/OFF switch 17 is closed, preferably closed. No current passes between the terminals 19, 20 except through the resistor 36 and pilot lamp 18. Sufficient current passes through the pilot lamp 18 to cause it to be continuous lighted. Thus with the illuminating lamp 25 inactive, the pilot lamp 18 will be continuously glowing, provided that the illuminating lamp 25 is not burned out. The current flowing through the illuminating lamp 25 is insufficient to cause lighting. If the illuminating lamp 25 is burned out, then the pilot lamp 18 will not glow when the main ON/OFF switch 16 is open (i.e., in the OFF position).

II. Outdoor lamp ON, normal operation.

The main ON/OFF switch 16 is closed (i.e., in the OFF position) allowing current to flow from the terminal 19 through the main ON/OFF switch 16 and through the normally closed emergency signal ON/-OFF switch 17 to the terminal 20 to complete a low resistance path for the illuminating lamp 25. Thus the illuminating lamp 25 is ON. Insufficient current passes through the pilot lamp 18 because it is in a high resistance path parallel to the described low resistance path.

III. Alarm flashing mode

When the operator desires that the illuminating lamp 25 function in the emergency signal flashing mode, the emergency signal ON/OFF switch 17 is moved from its normally closed position to the alternative open position so that the only connection between the terminal 20 and the intermediate terminal 31 is through the thermal, bimetallic switch 30. The thermal bimetallic switch 30 has a switch arm 32 which is formed from two metallic strips secured together. The differential thermal expansion of the two metallic strips in the switch arm 32 causes the arm to move when heated toward a closed position engaging the switch contact 34. When the switch arm 32 reaches a closed position and creates a low resistance path between contacts 33, 34, electrical current passes through the switch arm 32.

When the emergency signal ON/OFF switch 17 is open, a first alternative path is provided from the terminal 20 through the switch contact 33, the high resistance heating wire 35, the switch contact 34 to the intermediate terminal 31. The current flowing through the high resistance heating wire 35 heats the thermal bimetallic switch arm 32 causing it to engage the switch contact 34 to provide a low resistance path in parallel to the high resistance heating wire 35. In this condition, insufficient current passes through the high resistance heating wire 35; the thermal bimetallic switch arm 32 cools and separates from engagement with the switch contact 34 thus interrupting the low resistance path so that the illuminating lamp 25 is lighted. The high resistance heating wire 35 reheats to repeat the flashing ON/OFF cycle. The terminals 19, 20 divide the current through (a) a high resistance path including the resistor 36 and pilot lamp 18; and (b) the high resistance heating wire 35 so that heat is generated in the wire 35 and the pilot lamp 18 is lighted. When the thermal bimetallic switch arm engages the switch contact 34, the resulting low resistance path reduces the current flowing through the pilot lamp 18 causing it to darken.

SUMMARY

In the illuminating lamp ON mode, the illuminating lamp 25 is ON and the pilot lamp 18 is OFF.

In the illuminating lamp OFF mode, the illuminating lamp 25 is OFF and the pilot lamp 18 is ON.

In the emergency signal mode, the illuminating lamp 25 flashes and the pilot lamp 18 also flashes. Thus from inspection of the switch unit 10, the operator can determine the instantaneous condition of the illuminating lamp 25 by observing the visible indications of the pilot lamp 18.

The operation of independent electrical devices 39 is independent of the emergency signal control provided by the emergency signal ON/OFF switch 17 so that the electrical devices 39 operate solely under the control of the second ON/OFF switch 37 which is operated by the main ON/OFF switch 16.

The switch unit is particularly useful for indicating a need for assistance. Neighbors, observing an outdoor lamp flashing, can be alerted to assist the homeowner. The switch unit also is useful when there is a need to identify the location of the house for prompt, certain direction to emergency professionals.

We claim:

1. A self-contained switch unit for controlling an illuminating lamp, comprising: a pair of switch terminals, a visible pilot lamp and high resistor connected in series across said input terminals, said visible pilot lamp adapted to glow when said illuminating lamp is deactivated and to be dark when said illuminating lamp is activated; an intermediate terminal; a first main ON/-OFF switch for alternatively activating and deactivating said illuminating lamps, said first main ON/OFF switch joining a first terminal to said intermediate terminal; a second emergency signal ON/OFF switch to cause said illuminating lamp to alternate from an activated state to a deactivated state, said second emergency signal ON/OFF switch joining the other input terminal to said intermediate terminal; a normally open thermal switch connecting said other input terminal to said intermediate terminal in parallel with said second emergency signal ON/OFF switch.

2. The switch unit of claim 1 wherein the said first main ON/OFF switch means is one color and the said second emergency signal ON/OFF switch means is another color.

3. The switch unit of claim 1 wherein the said first main ON/OFF switch means is a toggle switch and said second emergency signal ON/OFF switch means is a rocker switch.

4. The switch unit of claim 1 wherein the thermal switch is bimetallic switch.

* * * * *